United States Patent [19]

Galaske et al.

[11] 4,294,555

[45] Oct. 13, 1981

[54] MULTI-ROW KEYBOARD FOR TYPEWRITERS OR SIMILAR MACHINES

[75] Inventors: Folker Galaske; Oswald Hack, both of Pforzheim, Fed. Rep. of Germany

[73] Assignee: International Standard Electric Corporation, New York, N.Y.

[21] Appl. No.: 116,228

[22] Filed: Jan. 28, 1980

[30] Foreign Application Priority Data

Feb. 1, 1980 [DE] Fed. Rep. of Germany ..... 2903780

[51] Int. Cl.[3] ..... B41J 5/10; B41J 5/16

[52] U.S. Cl. ..... 400/488; 400/490; 400/489; 400/495; 400/496; 340/365 R; 235/145 R

[58] Field of Search ..... 400/472, 488–490, 400/492, 495, 496; 403/3, 4; 340/365; 200/340.5 A; 235/145

[56] References Cited

U.S. PATENT DOCUMENTS

| | | | |
|---|---|---|---|
| 2,102,526 | 12/1937 | Guilfoyle | 400/491 |
| 2,369,807 | 2/1945 | Solon | 400/489 |
| 2,425,808 | 8/1947 | Jakosky | 403/4 |
| 2,600,101 | 6/1952 | Faulhaber | 403/4 |
| 2,615,548 | 10/1952 | Hopkins et al. | 400/495 |
| 3,667,787 | 6/1972 | Semour | 400/492 |
| 3,730,322 | 5/1973 | Hare | 400/496 |
| 3,821,529 | 6/1974 | Kallage, Jr. et al. | 400/495 |
| 4,077,657 | 3/1978 | Trzeciak | 403/4 |
| 4,123,641 | 10/1978 | Murata | 400/495 |

FOREIGN PATENT DOCUMENTS

| | | | |
|---|---|---|---|
| 184041 | 11/1905 | Fed. Rep. of Germany | 400/496 |
| 1234053 | of 0000 | Fed. Rep. of Germany . | |
| 1255117 | 11/1967 | Fed. Rep. of Germany | 400/489 |
| 2807061 | 8/1979 | Fed. Rep. of Germany | 340/365 R |
| 129499 | 1/1978 | German Democratic Rep. | 403/4 |
| 741462 | 12/1955 | United Kingdom | 400/495 |

OTHER PUBLICATIONS

R. H. Harris, "Curved Keyboard," IBM Tech. Disclosure Bulletin, vol. 20, No. 7, pp. 2784–2785, 12/77.

*Primary Examiner*—William Pieprz
*Attorney, Agent, or Firm*—Thomas L. Peterson

[57] ABSTRACT

Keyboards designed in accordance with ergonomic viewpoints are slightly dished transversely in relation to the longitudinal direction and the key surfaces have a slope tending toward the dished shape. According to the invention, this arrangement is accomplished with the aid of adapters located between the key element plungers and the keyheads. For each row of keys there is provided a special type of adapter. The types of adapters differ from one another in their effective heights and in the slope angles of the supporting surfaces for the keyheads.

4 Claims, 2 Drawing Figures

MULTI-ROW KEYBOARD FOR TYPEWRITERS OR SIMILAR MACHINES

BACKGROUND OF THE INVENTION

The present invention relates to a multi-row keyboard for typewriters or similar machines.

More specifically, the invention relates to a keyboard comprising a set of keys consisting of individual key elements in which the keyheads are mounted to the plungers of the key elements in a position compensating for the inclined position of the set of keys.

As the result of studies for adapting the working means to the peculiarities and inherent laws of the working man, and pursuant to the handbook of office medicine and ergonomics "Arbeitswissenschaft fur die Buropraxis" by Dr. med. Th. Peters, Schilling Verlag, Herne, 1973, page 208, it was found to be appropriate to adapt the set of keys of a multi-row keyboard to the different curvature and movement of the fingers up to a certain degree. This can be achieved by arching the set of keys upwardly to become slightly shell-shaped (dished) in cross section.

In "Honeywell's Keyboard Handbook", Code No. 84-20164-0 1072, Section II, pp. 4 and 5, this recommendation is complied with in that an arched set of keys can be formed by using specifically shaped keyheads. This requires different types of keyheads for each row of keys, which must have different heights for achieving the dish effect, and in which the keyhead surfaces from row to row must be molded to include a different angle.

There is no complete international standardization of keyboard arrangements. Although considerable agreement has been reached, there are still quite a number of characters whose arrangement within the keyboard differs from country to country. For keyboard equipment manufacturers having a high export rate it is necessary, therefore, to arrange the keyboards in the way as customary in the respective country. It frequently occurs that characters are changed from one row of types into another. When using individually shaped keyheads, this requires that for each of these characters a plurality of keyhead designs must be manufactured and kept in stock. Moreover, during assembly, care has to be taken that each time the correct type of keyhead is mounted.

It is the object of the present invention to restrict the manufacture of keyheads to the absolutely necessary extent, and to simplify the assembly of the keyboard.

SUMMARY OF THE INVENTION

According to the principal aspect of the present invention, there is provided a multi-row keyboard for typewriters or similar machines comprising a set of keys arranged in an inclined position ($\alpha$) and comprising a plurality of individual keys arranged in rows. Each said key comprises a key element having a plunger and a keyhead connected to the plunger. The keyheads are in a position compensating for the inclined position. The center points of the upper surfaces of the keyheads lie in a plane arched transversely in relation to the longitudinal expansion of the set of keys. The upper surfaces have an inclination tending toward this plane. The keyheads of all rows of the set of keys all have the same shape. An adapter is located between each plunger and its associated keyhead. The heights of the adapters differ from row to row and the adapters have supporting surfaces for their respective keyheads having a slope (angle $\beta$) differing from row to row.

The advantage achieved by the invention resides in that the keyheads may all be of uniform shape. There are no longer required the various types of keyhead designs as in the prior art keyboards. Their place is taken by the various types of adapters of the present invention which can be easily marked and, therefore, may be easily distinguished.

DESCRIPTION OF THE PREFERRED EMBODIMENT

Figure 1:
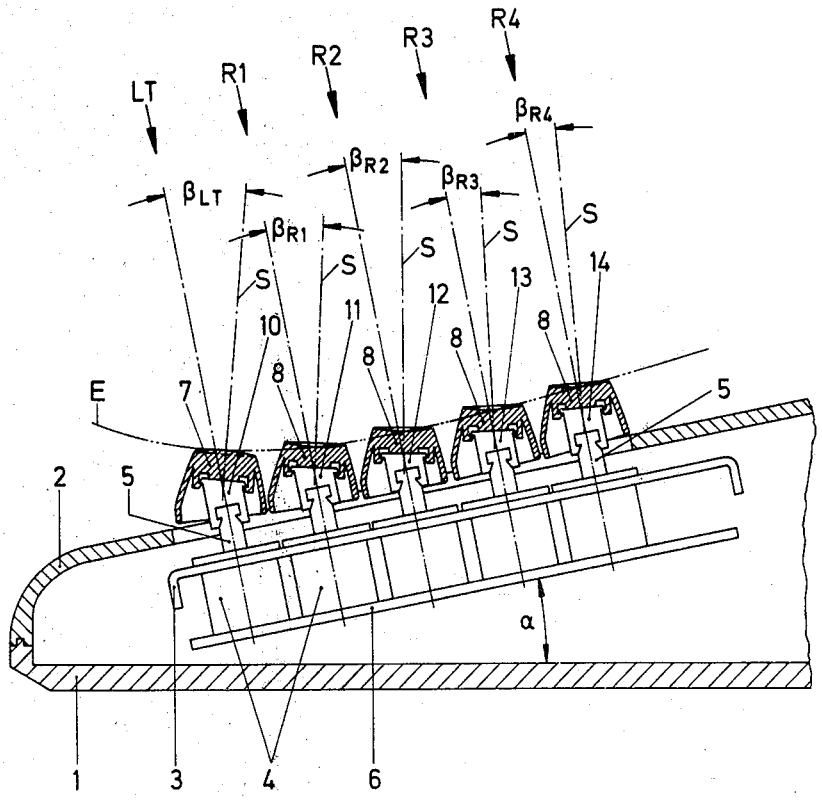
FIG. 1 is a transverse, vertical partial sectional view of a keyboard according to the invention.

FIG. 1 shows a keyboard consisting of four rows of keys R1 to R4 together with the associated space bar or release key, hereinafter referred to as the space bar LT. The keys comprise electromechanical key elements 4 which, in a holder 3, are assembled to form the set of keys. The key elements 4 are of conventional design which, when actuated, come into operative connection with a printed circuit board 6. The set of keys is arranged at an angle $\alpha$ in a keyboard housing consisting of a trough 1 and of a cover 2.

The key elements 4 each have a spring-loaded plunger 5 movable in the axial direction. Because of the sloped position of the set of keys including the angle $\alpha$, the plungers 5 are also sloped by the same angle with respect to the vertical line. The top surfaces of the plungers 5 all lie in a plane extending parallel in relation to the plane of the set of keys.

In order to arrive at an arrangement of the set of keys which is dished in cross-section by using keyheads 8 including the space bar body 7 which are all of uniform shape, special adapters 10 to 14 are inserted between the plungers 5 and the keyboards or the space bar body 7, respectively. For each of the rows of keys R1 to R4, as well as for the space bar LT, there is provided a particular type of adapter. Due to the embodiment of these adapters 10 to 14, to be described in greater detail hereinafter, and by using uniform types of keyheads 8, it is thus possible to arrange the latter in such a way that the center points of the key surfaces will come to lie in a plane which is dished transversely in relation to the longitudinal plane of the set of keys. This dished plane is illustrated in FIG. 1 by the dot-and-dash line E. The convexity may follow a circular or any other suitable function which, according to ergonomic findings, is best contoured to the different shapes and movements of the operator's fingers during operation of the keyboard.

Figure 2:
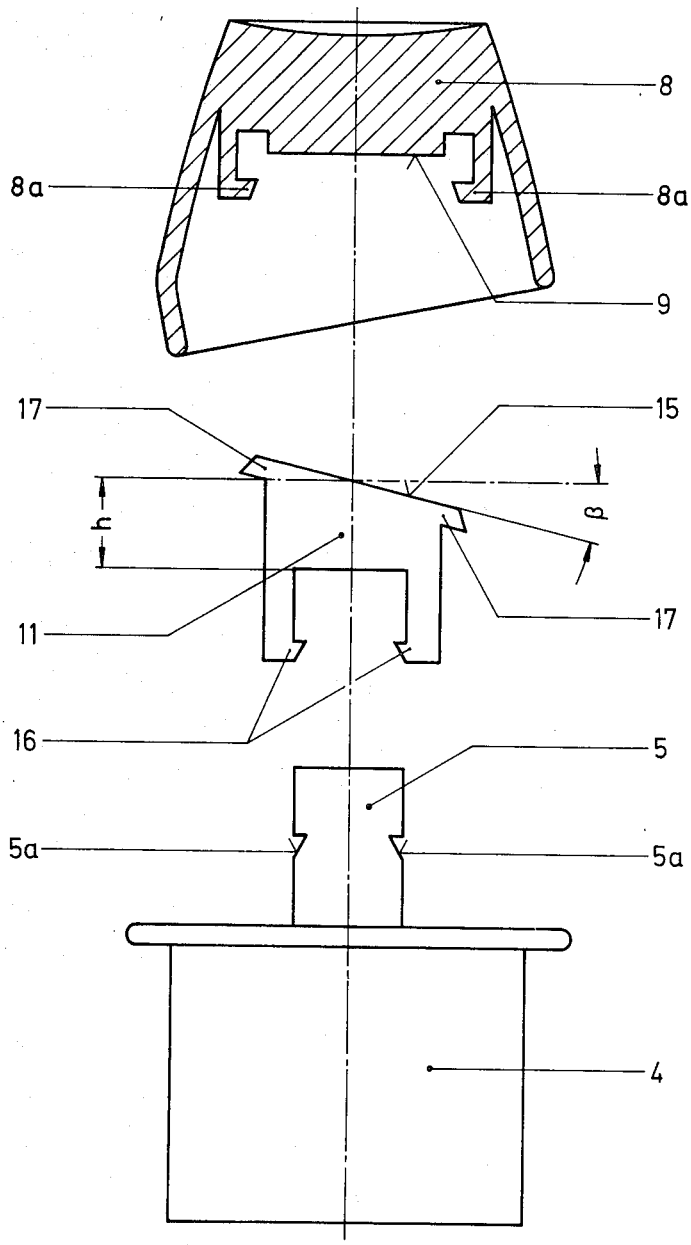
FIG. 2 is an exploded, enlarged, partial sectional view of a key used in the keyboard of FIG. 1.

FIG. 2 shows a key consisting of a key element 4, an adapter 11 and a keyhead 8. The plunger 5 of the key element is provided with notches 5*a* which, in the inserted state of the adapter 11, are engaged by the catch members 16, thus positively locking both parts together. The adapter 11 is seated without any clearance on the plane upper end surface of the plunger 5. The adapter has a predetermined body height h and an upper supporting surface 15 which is inclined with respect to the horizontal line by including an angle $\beta$. Lip-type latch members 17 extend along the upper and the lower edges of this supporting surface. Upon placing the keyhead 8 onto the adapter 11, the catch members 8*a* engage behind the lip-type latch members 17. As a result of this arrangement, the keyhead 8 comes to lie with its downwardly facing planar surface 9 firmly seated on the sloped supporting surface 15. Therefore, the mid-vertical line S (FIG. 1) on the key surface arranged perpendicular with the planar surface 9 in the assembled state of the keyhead 8 is sloped by the angle $\beta$ with respect to the longitudinal axis of the plunger 5.

As seen in FIG. 1, the adapters 10 to 14 not only have different body heights h, but also differently sloped supporting surfaces 15 (angle $\beta$).

The following table sets forth values of the heights and slope angles ($\beta$), of the adapter bodies shown in FIG. 1, which values are given by way of example only, and not by limitation:

| | Adapter | Body Height | Slope Angle $\beta$ |
|---|---|---|---|
| Space Bar LT | 10 | X + 2 | $\alpha + 5.0°$ |
| Row of Keys R1 | 11 | x + 1 | $\alpha + 2.5°$ |
| Row of Keys R2 | 12 | x | $\alpha$ |
| Row of Keys R3 | 13 | x + 1 | $\alpha - 2.5°$ |
| Row of Keys R4 | 14 | x + 2 | $\alpha - 5.0°$ |

The dished shape of the set of keys is achieved in that the body height h of the adapters 10 to 14 first decreases and thereafter increases from row to row. By the different slope angle $\beta$ it is seen that the key surfaces assume an angular position tending toward the plane of the dished shape, with this being adapted to the movement of the more or less stretched fingers of the operator.

For the purpose of facilitating the assembly and for avoiding mistakes, the various types of adapters are marked distinguishably, e.g. by different color codes.

In the case of larger quantities, it may be advisable to integrate the adapters in the key element plungers. By differently coloring the plungers there is provided an easy distinguishability therebetween.

What is claimed is:

1. A multi-row keyboard for typewriters or similar machines comprising a set of keys arranged in an inclined position ($\alpha$) and comprising a plurality of individual keys arranged in parallel, longitudinally extending rows, each said key comprising a key element having a plunger and a keyhead connected to said plunger, the center points of the upper surfaces of said keyheads lying in a plane dished transversely in relation to the longitudinal direction of said rows of keys, wherein the improvement comprises:

said keyheads of all rows of said set of keys all having the same shape;

an adapter being located between each said plunger and its associated keyhead;

the heights of said adapters differing from row to row of said keys; and said adapters having supporting surfaces for their respective keyheads having a slope (angle $\beta$) differing from row to row of said keys, said slope angles of said supporting surfaces being selected to cause said upper surfaces of said keyheads to lie in said dished plane.

2. A multi-row keyboard as set forth in claim 1, including:

a space bar below said set of keys, and an adapter locating said space bar in height and slope corresponding to the height and the slope of said set of keys.

3. A multi-row keyboard as set forth in claim 2 wherein:

said set of keys includes a center row of keys (R2); and said slope angles ($\beta$) of said supporting surfaces with respect to the vertical lines of said keyheads decrease from said space bar toward the uppermost row of said keys, and from row to row by predetermined angular amounts, with the slope angle ($\beta$ R2) of the supporting surfaces of the adapters in said center row of keys (R2) being equal to the angle ($\alpha$) of inclination of the set of keys.

4. A multi-row keyboard as set forth in claim 1 wherein:

said adapters have a latching connection to their respective plungers and keyheads.

* * * * *